US005943787A

United States Patent [19]

Kilpiä et al.

[11] Patent Number: 5,943,787

[45] Date of Patent: Aug. 31, 1999

[54] WEB FINISHING SECTION IN A PAPER MACHINE

[75] Inventors: Jukka Kilpiä, Muurame; Jyrki Rantanen, Jyväskylä; Sirkka Lehtonen, Jyskä, all of Finland

[73] Assignee: Valmet Corporation, Helsinki, Finland

[21] Appl. No.: 09/033,771

[22] Filed: Mar. 3, 1998

Related U.S. Application Data

[60] Provisional application No. 60/042,106, Mar. 26, 1997.

[30] Foreign Application Priority Data

Mar. 3, 1997 [FI] Finland ..... 970904

[51] Int. Cl.[6] ..... D21F 5/00; F26B 11/02

[52] U.S. Cl. ..... 34/117; 34/120; 34/625

[58] Field of Search ..... 34/443, 447, 457, 34/462, 466, 111, 116, 117, 120, 623, 625; 162/358.1, 358.3, 360.3; 242/526.3, 532.2, 533.2, 541.1, 541.3

[56] References Cited

U.S. PATENT DOCUMENTS 4,179,330 12/1979 Page ..... 162/113
5,251,835 10/1993 Kyytsonen ..... 242/65
5,483,873 1/1996 Koivukunnas et al. ..... 100/38
5,493,790 2/1996 Brossard ..... 34/117
5,531,396 7/1996 Kinnunen et al. ..... 242/526.3

FOREIGN PATENT DOCUMENTS 0648893 4/1995 European Pat. Off. ..... D21G 1/00
8702722 5/1987 WIPO ..... D21F 11/00

*Primary Examiner*—Henry Bennett
*Assistant Examiner*—Steve Gravini
*Attorney, Agent, or Firm*—Steinberg & Raskin, P.C.

[57] ABSTRACT

A web finishing section in a paper machine including a dryer section having one or more dryer groups, a calender and a reel-up. The calender is placed at least partly underneath the reel spool storage space of the reel-up so that the reel-up is placed substantially directly after the calender, in which case, the web is passed directly from the calendering nip onto the reel cylinder or to a substantially short distance from the calender, the web being passed over one guide member that supports and/or spreads the web onto the reel cylinder. A method for finishing a web is also described.

14 Claims, 2 Drawing Sheets

WEB FINISHING SECTION IN A PAPER MACHINE

This application claims benefit of Provisional Application. 60/042,106 filed Mar. 26, 1997.

FIELD OF THE INVENTION

The present invention relates to a web finishing section in a paper machine, which finishing section comprises a dryer section comprising one or more dryer groups, a calender arranged after the dryer section and a reel-up arranged after the calender.

The present invention relates to a method for finishing a web in a finishing section of a paper machine, in which the web is dried in a dryer section comprising one or more dryer groups, calendered in a calender arranged after the dryer section and reeled onto a reel spool in a reel-up arranged after the calender.

BACKGROUND OF THE INVENTION

In the prior art embodiments of finishing sections in paper machines, both before the calender and in particular from the calender to the reel-up, the web has long, substantially free or unsupported draws, which increases the length of the finishing section in the paper machine to a substantial extent and requires threading ropes for the threading of the leader of the web. Further, at these draws, various quality measurement devices are arranged for measuring and monitoring the quality of the paper web. Costs have, of course, also arisen from the paper guide rolls required by the draws. Thus, the long draws of the paper web have also required threading ropes and related arrangements of equipment and equivalent, by whose means the leader of the paper web is carried during threading from one stage into the other, which has increased the costs of equipment further.

OBJECTS AND SUMMARY OF THE INVENTION

It is an object of the present invention to provide a finishing section for a paper machine in which the problems described above have been eliminated or at least minimized.

It is a further object of the present invention to provide a finishing section for a paper machine in which the length of the finishing section can be made shorter compared with the finishing sections currently in use.

It is another object of the present invention to provide new and improved methods for finishing a web in a finishing section of a paper machine in which the path of travel of the web is less than in prior art finishing sections.

In view of achieving the objects stated above and those that will come out later, the finishing section in a paper machine in accordance with the present invention comprises a calender placed at least partly underneath the reel spool storage space of the reel-up so that the reel-up is placed substantially directly after the calender. In this manner, the web is passed directly from the calendering nip onto the reel cylinder or to a substantially short distance from the calender, the web being passed over one guide member that supports and/or spreads the web onto the reel cylinder.

The arrangement in accordance with the present invention permits a ropeless threading, because there are no long unsupported draws, in which case, for threading, it is possible to use, for example, guide plates and/or equivalent suitable for full-width transfer of the web. For example, in an application in which the calender is a belt calender and the reel-up is a belt reel-up, ropeless threading can be arranged particularly simply so that the web is passed from the last drying cylinder in the dryer section by means of guide plates or equivalent directly onto the belt in the belt calender, on whose belt the web is passed through the calendering nips and further onto the belt in the belt reel-up. One belt calender is described in the current assignee's Finnish Patent Application No. 931021, and one application of a belt reel-up is described in the current assignee's Finnish Patent Application No. 935669.

The arrangement in accordance with the present invention is partly made possible by the fact that, at present, various quality meters are in themselves known whose size is considerably smaller than the size of meters that were in use earlier, in which case such meters can be arranged in a simple way in connection with a calender, in particular with a soft calender, and/or with a reel-up without a separate support construction provided for such meters.

By means of an arrangement in accordance with the invention, considerable economies of length are obtained in the finishing section, which economies of length correspond, for example, to a distance in which a group consisting of six drying cylinders can be accommodated, in which case, the capacity of the dryer section can be increased without changing the overall length of the machine. On the other hand, with the same overall length, the production rate can be increased, for example, from about 615 tons to about 735 tons per day, or the speed from about 1500 meters per minute to about 1800 meters per minute, which corresponds to an increase in production of about 16 percent. Of course, owing to the present invention, it is also possible to construct a machine of shorter length, compared with the prior art, with unchanged capacity, in which case, economies can be obtained, for example, in the costs of construction of the paper machine hall, which costs in themselves constitute a major cost item, since the cost per meter of a paper machine hall is about one million Finnish marks.

By means of an arrangement in accordance with the invention, modernizations of existing paper machines in view of increasing their capacity are also made possible, which modernizations could not be carried out earlier because of lack of space.

In the arrangement in accordance with the invention, the short web draws after the calender permit a full-width threading of the web based on what is called the "coanda effect", because the exclusively airborne support and guiding of the web, which is difficult to control over unduly long distances, can be reduced to a minimum.

In the arrangement in accordance with the invention, economies are also obtained in the paper guide rolls (2 rolls), and just one pulper is needed, because a common pulper can be used for the dryer section and for the reel-up as the distance between them becomes shorter.

If cooling of the web is needed between the calender and the reel-up, it is possible to use various cooling devices in themselves known, such as a blow box.

The advantages of the present invention are manifested particularly well in a combination of a soft calender and a reel-up marketed by the assignee under the trademark Optireel™, which reel-up is described in more detail, e.g., in the current assignee's Finnish Patent Application No. 905284 (corresponding to U.S. Pat. No. 5,251,835, incorporated by reference herein).

A method for finishing a web in a finishing section in a paper machine in accordance with the invention comprises the steps of drying the web by passing the web through a dryer section having at least one dryer group, then calendering the dried web after the dryer section by passing the web through a calendering nip defined by a pair of rolls, then reeling the calendered web in a reel-up by passing the web over a reel cylinder onto a reel spool, and storing empty reel spools for use in the reel-up in a reel spool storage space defined above the calendering nip. The web may be supported in a run between the calendering nip and the reel cylinder by means of a single guide roll. The calender may be arranged substantially directly after a last one of the at least one dryer group in the dryer section in a running direction of the web, the last dryer group possibly being a twin-wire draw dryer group or a single-wire draw dryer group.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE INVENTION

Figures 1A, 1B:
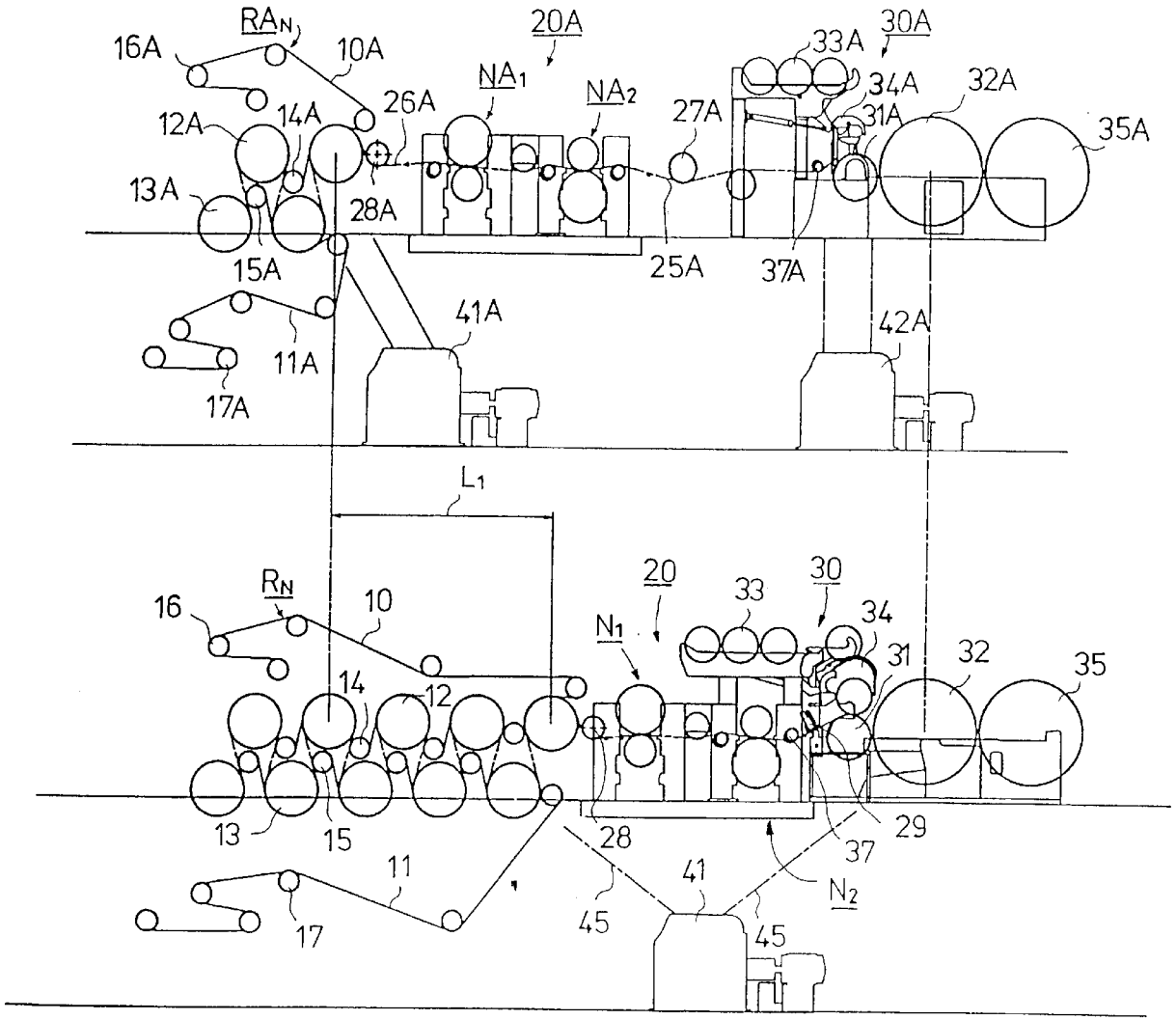
FIG. 1A PRIOR ART
FIG. 1A is a schematic illustration of a prior art paper machine arrangement, in which the last group in the dryer section is a dryer group with twin-wire draw.
FIG. 1B is a schematic illustration of a finishing section in an arrangement in accordance with the present invention in which, as in FIG. 1A, the last group in the dryer section is a dryer group with twin-wire draw.

In the drawings, corresponding reference numerals refer to corresponding parts, and the letter symbol A added after a reference numeral refers to the prior art arrangements.

In the prior art arrangement shown in FIG. 1A, the last dryer group $RA_N$ in the dryer section in the finishing section makes use of twin-wire draw, after which group the web is passed as a draw 26A to a soft calender 20A, which is followed by a second draw of the web 25A, supported by paper guide rolls 27A, to a reel-up 30A. Pulpers 41A and 42A of the dryer section and the reel-up 30A, respectively, are placed below the machine level in the so-called basement space.

In the twin-wire draw in the dryer group $RA_N$, endless wires 10A, 11A run while being guided by guide means, such as guide rolls 16A, 17A, over drying cylinders 12A, 13A and reversing rolls 14A, 15A in the manner of twin-wire draw. The web has free draws between the rows of drying cylinders 12A,13A, as in a standard twin-wire draw dryer group. From the dryer group $RA_N$, the paper web is passed over a guide roll 28A as the draw 26A into a first calendering nip $NA_1$ in the calender 20A. The web is passed from the first calendering nip $NA_1$, into a second calendering nip $NA_2$, and from there as the draw 25A over the guide rolls 27A to the reel-up 30A. The storage space for reel spools in the reel-up 30A is denoted by reference numeral 33A, the reel spool change devices are denoted by reference numeral 34A, the reel cylinder is denoted by reference numeral 31A, the paper reel that is being formed is denoted by reference numeral 32A, and the complete machine reel is denoted by reference numeral 35A.

As shown in FIG. 1B, the length of the finishing section in the paper machine in accordance with the invention is shorter so that the draws 26A,25A between the last dryer group $R_N$ and the soft calender 20 and between the soft calender 20 and the reel-up 30 have become substantially shorter. Specifically, to accomplish this, the reel spool storage space 33 of the reel-up 30 is placed above the soft calender 20 entirely above the calendering nip $N_1$, and the pulpers of the dryer section and of the reel-up are combined into a single pulper 41. In the dryer group $R_N$, the drying wires are denoted by reference numerals 10,11, and they run, guided by guide means such as guide rolls 16,17, over drying cylinders 12,13 and reversing rolls 14,15. Between the rows of drying cylinders 12,13, the web has free draws. From the last drying cylinder, the web is passed as a short draw over a roll 28 into a first calendering nip $N_1$ in the calender 20, from which it is passed into a second calendering nip $N_2$. The web is passed over a single roll 37 past a quality meter 29 and then passed over a reel cylinder 31 to be reeled as a paper reel 32. The reel spool storage space in the reel-up 30 is denoted by reference numeral 33, the reel spool change device is denoted by reference numeral 34, and the complete machine reel is denoted by reference numeral 35.

As exemplified by the comparison of FIGS. 1A and 1B, economies of length are achieved in the arrangement in accordance with the invention, i.e., it is shorter. By way of example, it can be stated that in an embodiment of the invention, the economies of length $L_1$ in a transition from an arrangement as shown in FIG. 1A into an arrangement as shown in FIG. 1B are about 7650 mm.

Figure 2A:
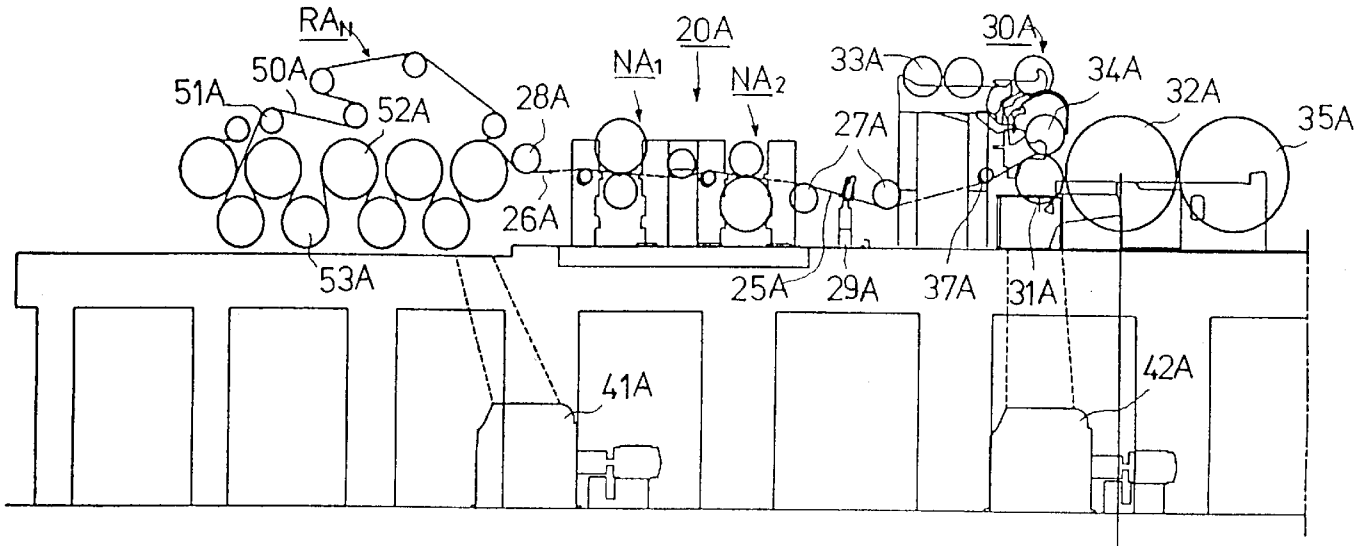
FIG. 2A PRIOR ART
FIG. 2A is a schematic illustration of a prior art arrangement of a finishing section in a paper machine, wherein the last group in the dryer section has been arranged as a group with single-wire draw.

FIG. 2A is a schematic illustration of a prior art arrangement for a finishing section in a paper machine, in which the last dryer group $RA_N$ in the dryer section is a dryer group with single-wire draw. The pulper 41A of the last dryer group $RA_N$ is placed in the basement space. From the last dryer group $RA_N$, the paper web is passed as the draw 26A to the soft calender 20A, where it is calendered from both sides in calendering nips $NA_1$, $NA_2$, after which the web is passed to the reel-up 30A, where a machine reel 32A,35A is formed out of the web. In the dryer group $RA_N$ in the dryer section, the drying wire is denoted by reference numeral 50A, the wire guide rolls are denoted by reference numeral 51A, the drying cylinders are denoted by reference numeral 52A, and the vac rolls in the lower row with the reference numeral 53A. The paper web to be dried runs, in the single-wire draw, from the drying cylinders 52A onto the reversing rolls 53A while constantly supported by the drying wire 50A. After this, the run of the web onward is similar to the arrangement shown in FIG. 1A. In the embodiment shown in FIG. 2A, a quality measurement device 29A is arranged between the calender 20A and the reel-up 30A.

Figure 2B:
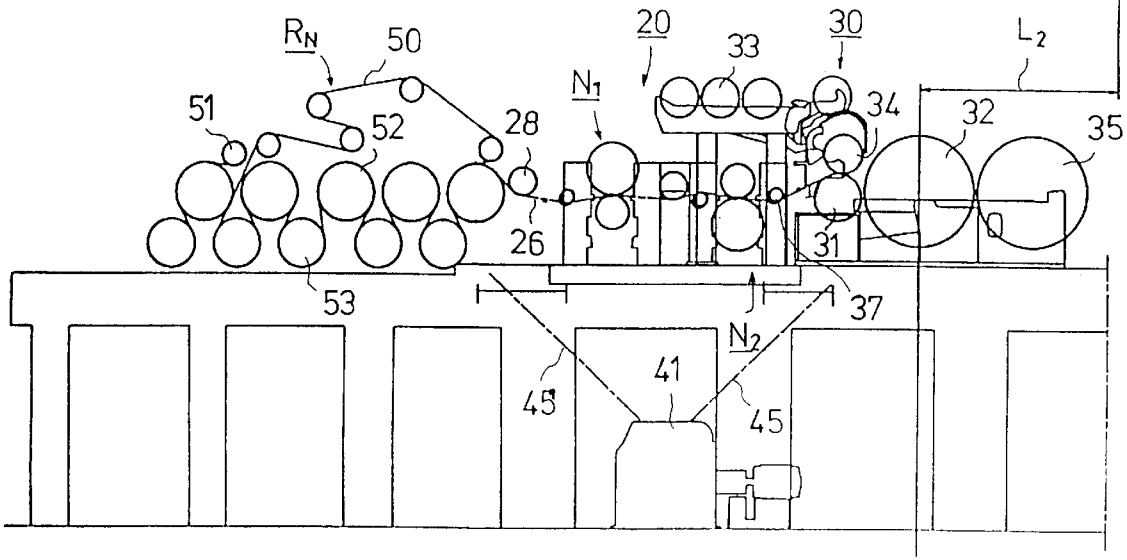
FIG. 2B is a schematic illustration of a finishing section in accordance with the present invention in which, as in FIG. 2A, the last group in the dryer section is a dryer group with single-wire draw.

In the schematic illustration of the embodiment shown in FIG. 2B, the finishing section in the paper machine has been made shorter in accordance with the invention, in which connection the draw 26 from the dryer section to the soft calender 20 has been made slightly shorter and the draw from the soft calender 20 to the reel-up 30 has been eliminated completely as the reel spool storage space 33 in the reel-up 30 is placed above the soft calender 20, whereby considerable economies of space are achieved. The dryer group $R_N$ is a dryer group with single-wire draw, in which the paper web runs on the support of the drying wire 50 from the drying cylinders 52 in the upper row onto the vac rolls 53, which are placed in the lower row. The wire 50 guide rolls are denoted by reference numeral 51. The draw in the final part of the finishing section is substantially similar to that described above in relation to FIG. 1B.

In a transition from the arrangement of FIG. 2A to the arrangement of FIG. 2B, the economies of length $L_2$ that are achieved are, for example, about 6300 mm.

In accordance with the invention, when the finishing section is made shorter, the upper roll of the second nip $N_2$ in the soft calender 20 can be raised from the machine directly upwards through the reel spool storage space 33, which results in an easy and quick replacement of the roll, i.e., the production efficiency of the machine is increased as the time taken by the change of the roll becomes shorter. In the reel spool storage space 33 above the roll, parts, for example latches or equivalent, are opened and permit lifting of the roll through the frame system of the reel spool storage space 33. The frame system of the reel spool storage space 33 is supported on the to floor level by means of columns of its own from outside the frame system of the soft calender 20 in order to avoid detrimental effects of oscillations in the soft calender 20. The frame system is supported from both of its ends in the machine direction. By means of the operations described above, easy and quick change of roll is achieved in the soft calender 20, and oscillation-free storage 33 is obtained for the reel spools. Spreading of the effects of formation of dust that may occur in the reel-up 30 to the calender 20 is prevented by, if necessary, constructing an air jet and/or a detachable shield wall (not shown) between the calender 20 and the reel-up 30. A quality measurement beam is constructed between the columns placed between the calender 20 and the reel-up 30 in an integrated way in consideration of attenuation of vibrations. For the reel-up 30 and for the calender 20, just one pulper 41 is needed, which is installed so that the web can be passed from the dryer section $R_N$, from the calender 20 and from the reel-up 30 into the pulper 41. Chutes 45 of the pulper 41 are designed sufficiently long and, if necessary, the pulper 41 is mounted sufficiently far down below in order to provide an inclination downwards. The frame of the reeling equipment 30 is separate from the frames of the reel spool storage space 33 and the calender 20, in which case vibrations and resonance of different components are avoided.

In FIGS. 1B and 2B, some preferred exemplifying embodiments are illustrated of the web finishing section in accordance with the invention in a paper machine. This is, of course, not supposed to confine the invention to such finishing sections alone, but variations of many other, different types are also possible. For example, instead of the cylinder dryer groups illustrated in the figures, the dryer groups can be constructed, for example, by employing a dryer concept based on the heat pipe effect (CONDEBELT), by means of airborne web dryers, dryers based on infrared radiation, etc. Of course, the reel-up and the calender shown in the figures can also differ from the embodiments illustrated in the figures. For example, instead of a soft calender it is possible to use calenders of different types, a machine stack, a supercalender, etc.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A web finishing section in a paper machine, comprising a dryer section having at least one dryer group for drying the web, a reel-up arranged after said dryer section for reeling the web, said reel-up including means defining a reel spool storage space in which empty reel spools are stored and a reel cylinder over which the web is passed to be reeled onto a reel spool, and a calender arranged after said dryer section and at least partly underneath said reel spool storage space such that said reel-up is situated substantially directly after said calender, said calender including a pair of rolls defining a calendering nip through which the web is passed to be calendered.

2. The finishing section of claim 1, wherein said calendering nip is situated entirely underneath said reel spool storage space.

3. The finishing section of claim 1, further comprising only a single guide member for supporting and/or spreading the web in a run between said calendering nip and said reel cylinder.

4. The finishing section of claim 1, wherein said calender is arranged substantially directly after a last one of said at least one dryer group in the dryer section in a running direction of the web.

5. The finishing section of claim 4, wherein said last dryer group in the dryer section is a twin-wire draw dryer group.

6. The finishing section of claim 4, wherein said last dryer group in the dryer section is a single-wire draw dryer group.

7. The finishing section of claim 4, wherein said last dryer group in the dryer section is a dryer group based on the heat pipe effect.

8. The finishing section of claim 4, wherein said last dryer group in the dryer section is a dryer group based on airborne web dryers.

9. The finishing section of claim 4, wherein said last dryer group in the dryer section is a dryer group based on infrared radiation drying.

10. The finishing section of claim 1, wherein said calender is a soft calender.

11. The finishing section of claim 1, wherein said calender is a machine stack.

12. The finishing section of claim 1, wherein said calender is a supercalender.

13. The finishing section of claim 1, wherein said calender further comprises an additional calendering nip defined by a pair of rolls, said additional calendering nip being arranged before said calender nip arranged underneath said reel spool storage space in a running direction of the web.

14. The finishing section of claim 1, further comprising a single pulper for receiving pulp from said dryer section, said calender and said reel-up.

* * * * *